US010844529B2

(12) United States Patent
Abubakar et al.

(10) Patent No.: US 10,844,529 B2
(45) Date of Patent: Nov. 24, 2020

(54) SPUNBOND FABRICS COMPRISING PROPYLENE-BASED ELASTOMER COMPOSITIONS AND METHODS FOR MAKING THE SAME

(71) Applicant: ExxonMobil Chemical Patents Inc., Baytown, TX (US)

(72) Inventors: Saifudin M. Abubakar, Shanghai (CN); Li Hua Chen, Shanghai (CN)

(73) Assignee: ExxonMobil Chemicals Patents Inc., Baytown, TX (US)

( * ) Notice: Subject to any disclaimer, the term of this patent is extended or adjusted under 35 U.S.C. 154(b) by 386 days.

(21) Appl. No.: 15/144,244

(22) Filed: May 2, 2016

(65) Prior Publication Data

US 2017/0314171 A1 Nov. 2, 2017

(51) Int. Cl.

| | |
|---|---|
| ***D04H 3/007*** | (2012.01) |
| ***D04H 3/14*** | (2012.01) |
| ***D01F 6/30*** | (2006.01) |
| ***D01D 5/08*** | (2006.01) |

(52) U.S. Cl.

CPC ..... *D04H 3/007* (2013.01); *D01F 6/30* (2013.01); *D04H 3/14* (2013.01); *D01D 5/08* (2013.01)

(58) Field of Classification Search

USPC ..... 264/45.8, 45.9, 46.1

See application file for complete search history.

(56) References Cited

U.S. PATENT DOCUMENTS

| | | | |
|---|---|---|---|
| 4,101,614 | A | 7/1978 | Havens |
| 4,543,399 | A | 9/1985 | Jenkins, III et al. |
| 4,588,790 | A | 5/1986 | Jenkins, III et al. |
| 4,820,142 | A | 4/1989 | Balk |
| 5,001,205 | A | 3/1991 | Hoel |
| 5,028,670 | A | 7/1991 | Chinh et al. |
| 5,317,036 | A | 5/1994 | Brady, III et al. |
| 5,352,749 | A | 10/1994 | DeChellis et al. |
| 5,405,922 | A | 4/1995 | DeChellis et al. |
| 5,436,304 | A | 7/1995 | Griffin et al. |
| 5,453,471 | A | 9/1995 | Bernier et al. |
| 5,462,999 | A | 10/1995 | Griffin et al. |
| 5,616,661 | A | 4/1997 | Eisinger et al. |
| 5,627,242 | A | 5/1997 | Jacobsen et al. |
| 5,665,818 | A | 9/1997 | Tilston et al. |
| 5,668,228 | A | 9/1997 | Chinh et al. |
| 5,677,375 | A | 10/1997 | Rifi et al. |

(Continued)

FOREIGN PATENT DOCUMENTS

| | | |
|---|---|---|
| EP | 0 634 421 | 1/1995 |
| EP | 0 794 200 | 9/1997 |

(Continued)

OTHER PUBLICATIONS

Bird et al., Dynamics of Polymeric Liquids, vol. 1, "*Fluid Mechanics*", Second Edition, John Wiley & Sons (1987).

(Continued)

*Primary Examiner* — Lynda Salvatore

(57) ABSTRACT

A polymer composition for forming spunbond fabrics offers a unique combination of simplicity and processability, while allowing fabrics formed therefrom to exhibit suitable elasticity and/or tensile strength. The polymer composition includes an propylene-based elastomer component exhibiting a particular combination of MFR and comonomer content, so as to allow for improved processability with minimal, if any, need for blending partners in the polymer composition, while still permitting fabrics formed therefrom to exhibit improved elasticity and/or tensile strength.

11 Claims, 10 Drawing Sheets

(56) References Cited

U.S. PATENT DOCUMENTS

| | | | |
|---|---|---|---|
| 6,218,010 | B1 | 4/2001 | Georgellis et al. |
| 6,342,565 | B1 | 1/2002 | Cheng et al. |
| 6,525,157 | B2 | 2/2003 | Cozewith et al. |
| 6,635,715 | B1 | 10/2003 | Datta et al. |
| 6,881,800 | B2 | 4/2005 | Friedersdorf |
| 7,863,206 | B2 | 1/2011 | Harrington |
| 7,902,093 | B2 | 3/2011 | Dharmarajan et al. |
| 7,943,701 | B2 | 5/2011 | Dharmarajan et al. |
| 8,013,093 | B2 | 9/2011 | Datta et al. |
| 8,425,847 | B2 | 4/2013 | Devoy et al. |
| 8,728,960 | B2 | 5/2014 | Kacker et al. |
| 10,059,081 | B2 * | 8/2018 | Gallez ..... B32B 5/26 |

FOREIGN PATENT DOCUMENTS

| | | |
|---|---|---|
| EP | 0 802 202 | 10/1997 |
| WO | 96/33227 | 10/1996 |
| WO | 97/22639 | 6/1997 |
| WO | 01/64980 | 9/2001 |
| WO | 2004/014998 | 2/2004 |
| WO | 2004/029342 | 4/2004 |
| WO | 2008/091432 | 7/2008 |
| WO | 2010/039579 | 4/2010 |
| WO | 2013/095804 | 6/2013 |

OTHER PUBLICATIONS

Brandup et al., *Polymer Handbook*, Fourth Edition, John Wiley & Sons, Inc. (1999).

Harris, "*Effect of Blending on the Rheological Properties of Polystyrene*", Journal of Applied Polymer Science, vol. 17, pp. 1679-1692 (1973).

Lim, "*A Review of Spun Bond Process*", Journal of Textile and Apparel, Technology and Management, vol. 6, Issue 3, pp. 1-13 (Spring 2010).

* cited by examiner

SPUNBOND FABRICS COMPRISING PROPYLENE-BASED ELASTOMER COMPOSITIONS AND METHODS FOR MAKING THE SAME

CROSS REFERENCE TO RELATED APPLICATIONS

This application claims the benefit of and priority to PCT/CN2015/080848, filed Jun. 5, 2015, the disclosure of which is incorporated by reference in its entirety.

FIELD OF THE INVENTION

This invention relates to methods for forming spunbond materials from polymer compositions, and to composites and articles formed from such spunbond materials.

BACKGROUND OF THE INVENTION

Nonwoven fabrics comprised of processed polymers are in high demand for their use in multiple kinds of products, including clothing and hygienic fabrics such as diapers, surgical masks, surgical gowns, and the like. Of the nonwoven fabrics, spunbond fabrics are particularly attractive due to many factors, including the breathability such fabrics offer. In addition, many spunbond process lines are in existence, allowing a substantial degree of manufacturing throughput.

Spunbond processes typically involve passing a polymer composition through an extruder (optionally in combination with one or more additives such as coloring agents, resin modifiers, and the like), in which the polymer composition is melted. The molten polymer composition is then passed through a spinneret, comprising a plurality of small holes through which the molten polymer composition passes, forming molten polymer composition filaments. Cool or quench air is passed over the filaments as they exit, with the aim of cooling the filaments so as to solidify them, before they are deposited onto a collection surface such as a moving belt, where the filaments form a web. Frequently, spunbond processes employ some means of bonding to bond the filaments of the web together as they move along the collection surface. Examples include hydroentanglement, needlepunching, thermal bonding, and chemical bonding. After the fabrics are bonded, they may be further treated as they move farther along the moving collection belt (e.g., by dying, resin coating, or the like), after which they are rolled up and ready for shipment. For more details on spunbond processes in general, see Lim, H. A Review of Spun Bond Process. *Journal of Textile and Apparel, Technology and Management*, Vol. 6, Issue 3 (Spring 2010).

Typically, polymers such as styrene-block copolymers, olefin block copolymers (OBCs), thermoplastic polyurethanes (TPUs), polyester-polyurethane copolymers (such as spandex, also known as elastane), polypropylenes, high density polyethylenes, polyesters, polyamides, and others are used in the polymer compositions in these spunbond processes. Some attempts have been made at using copolymer compositions, such as propylene-ethylene copolymers, since they can provide improved elasticity to the formed fabric or fiber.

An alternative to polymer compositions typically used in spunbond processes is desired. To this end, various attempts at using polymer compositions comprising 100% or nearly 100% of an elastomer such as a propylene-ethylene copolymer elastomer have been made. The difficulty encountered in such attempts is one of trade-offs: in order to obtain properties suitable for processing of the polymer composition (e.g., one or more of sufficiently high MFR, melt strength, and crystallinity, and/or sufficiently rapid crystallizability), elasticity of the final product is frequently impaired. For instance, chain scission of polymer chains to result in shorter average chains (and therefore higher MFR, as desired for good processability) tends to impair the elasticity of the resulting article. To overcome these shortfalls in elastomeric compositions such as propylene-ethylene copolymers, blends are frequently used instead, combining high-MFR polymers with low-MFR polymers, and/or combining high- and low-crystallinity polymers, to form the polymer composition to be processed into spunbond and other nonwoven materials. While some of these solutions may provide the desired processability, they suffer from excessive complication, poor elastic properties of the resultant nonwoven, or both. On the other hand, modifying the compositions to improve simplicity and/or elasticity of the end product frequently results in compositions that are not easily processed. Obtaining a suitably low MFR for the maintenance of elastic properties typically requires the extrusion of the polymer composition to be operated at higher temperatures; however, this, in turn, means that the polymer composition will not crystallize as readily or as quickly upon being extruded, such that, by the time it is deposited onto a collecting surface from the extruder, it will still be too tacky and amorphous, making it incapable of further adequate processing (e.g., further bonding, calendering, rolling up, and the like).

Background references may include U.S. Pat. Nos. 6,218,010; 6,342,565; 6,525,157; 6,635,715; 7,863,206; and 8,013,093. IP.com Disclosure "Vistamaxx™ Performance Polymer/Ultrahigh Melt Flow Rate Polypropylene (UHMFR PP) Blend for Elastic Spunbond Fabric with Enhanced Processability," IP.com Disclosure Number IPCOM000239333D, Oct. 30, 2014 (IP.com) describes a previous attempt to use propylene-ethylene elastomers in spunbonding processes. This attempt encountered significant difficulty in processing the propylene-ethylene elastomer, such that significant amounts of high-MFR polypropylene were required in the blend just to obtain suitable processability (which significantly impaired the desired elasticity and tensile strength of the resulting nonwovens).

SUMMARY OF THE INVENTION

The present invention provides methods and materials that overcome the aforementioned obstacles, and/or that offer a variety of advantages in spunbond processes, including better processability of polymer compositions used in processes for forming spunbond nonwovens (e.g., spunbonding), and better elasticity of resulting materials (e.g., fibers and/or fabrics). That is, the present invention in some aspects includes a polymer composition having acceptable processability, and methods of processing the polymer composition into nonwoven materials that feature acceptable or even superior elasticity as compared to conventional nonwoven materials. This is surprising, given that one generally must sacrifice elasticity in order to obtain superior processability (e.g., by using polymer blend components having higher MFR), and vice-versa.

In particular, the invention in some aspects includes a method for forming a spunbond nonwoven material (e.g., a fabric or fiber) from a polymer composition comprising an elastomer component. The elastomer component is a propylene-based elastomer component, preferably a propylene-ethylene copolymer having an MFR ranging from about 30 g/10 min to about 80 g/10 min (as measured according to ASTM D-1238, 2.16 kg weight @ 230° C.) and an ethylene content of 10 to 14.5 wt %. The polymer composition may optionally further include a thermoplastic polymer, and one or more additives.

In some embodiments, the polymer composition may comprise (i) an elastomer component; (ii) optionally, a propylene-based thermoplastic, and (iii) optionally, one or more additives. Preferably, the propylene-based thermoplastic is present in very small quantities, such as less than 10 wt %, or less than 3 wt %, based on the total weight of the polymer composition. In certain embodiments, the polymer composition is a neat elastomer or consists essentially of, or consists of: (i) the elastomer component; (ii) 0-10 wt % of the propylene-based thermoplastic, and (iii) 0-40 wt %, or 0-10 wt %, or 0-3 wt %, of one or more additives. As used herein with respect to a polymer composition, "consists essentially of" means that the polymer composition may include other components besides the elastomer component, optional propylene-based thermoplastic, and optional additive(s) only insofar as such other components do not alter any of the following properties of the polymer composition (as compared to a polymer composition lacking said other components): MFR, crystallinity, and melt temperature. Similarly, such other components should not alter the permanent set or 50% unloading force (otherwise referred to as retractive force at 50% elongation) of a nonwoven material formed from such polymer compositions.

Spunbond fabrics formed from such polymer compositions may exhibit elastic properties such as one or more of: greater than 250% elongation at break; permanent set of 10% or less after a 2nd cycle of extension to 100% elongation; peak load of less than 20%; 50% unloading force of 1% to 4%; and hysteresis of 40% or less, each of the aforementioned properties being measured in either or both of the cross direction (CD) and the machine direction (MD) for spunbond material having a basis weight of 50-75 gsm (grams/$m^2$). "Ethylene content," as used herein with reference to a polymer composition, means the amount of ethylene-derived units present in the polymer composition. "Propylene content" and any other similar recitation of a monomer's content within a polymer composition have similar meanings, i.e., respective amounts of propylene-derived units and any other monomer-derived units.

Methods described herein include extruding one or more such polymer compositions so as to form a plurality of polymer composition filaments. The polymer compositions may be extruded through a spinneret so as to form the plurality of polymer composition filaments. The filaments may be further processed, e.g., in accordance with spunbonding processes. For instance, methods may further include depositing the filaments upon a collecting surface as a plurality of fibers, which may form a web. At least a portion of the fibers forming the web may then be bonded to each other (e.g., by being passed through compression rolls, heat-bonded, hydro-entangled, and/or needle-punched), thereby providing a spunbond nonwoven material. The spunbond nonwoven material may then be formed into composites of such spunbond materials (e.g., multilayer composites incorporating at least one layer of the spunbond materials), and articles of manufacture made from such spunbond materials (such articles having wide-ranging applications, including in clothing, diapers, surgical wear, carpet backing, other protective garments or covers, other home furnishings, and the like).

DETAILED DESCRIPTION OF THE EMBODIMENTS

Figure 1:
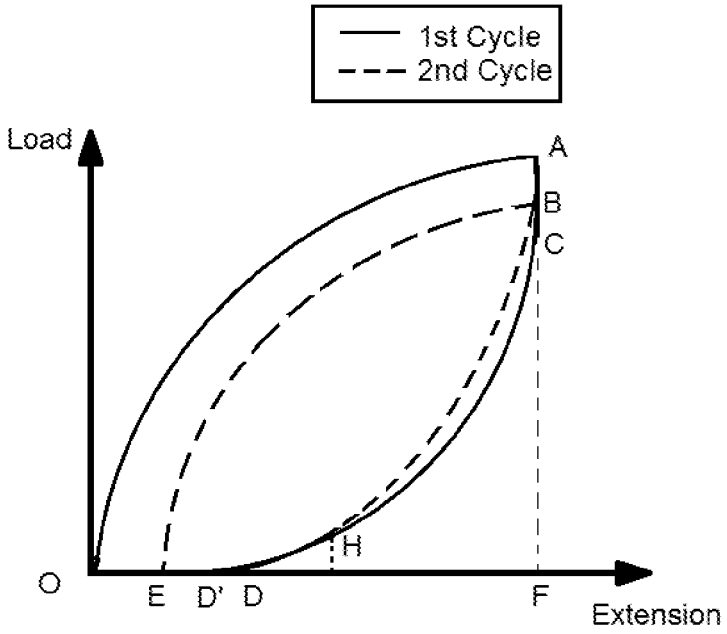
FIG. 1 is an illustration of a typical hysteresis curve provided for purposes of illustrating the determination of various elasticity properties described herein.

As will be set forth in greater detail below, the present invention describes spunbond processes and materials, as well as polymer compositions that are particularly suitable for use therein.

Particular embodiments include processing a polymer composition comprising (i) an elastomer component, (ii) optionally, 10 wt % or less of a propylene-based thermoplastic; and (iii) optionally, one or more additives. The processing may include extrusion so as to form a plurality of fibers and, optionally, bonding the fibers into a nonwoven material (e.g., according to spunbond processing techniques). That is, the processing may include forming a spunbond material from the polymer composition.

Preferably, the polymer composition consists essentially of, or consists of: (i) the elastomer component; (ii) 0-10 wt %, or 0-5 wt %, or 0-4 wt %, or 0-3 wt %, or 0-2 wt %, of a propylene-based thermoplastic, and (iii) 0-40 wt %, or 0-10 wt %, or 0-3 wt %, of one or more additives. The elastomer component, preferably is a propylene-ethylene copolymer, and has a MFR ranging from about 30 to 80 g/10 min, or from about 35 to about 55 g/10 min (as measured according to ASTM D-1238, 2.16 kg weight @ 230° C.) and an ethylene content of about 10 to about 14.5 wt %. In some embodiments, the propylene-ethylene copolymer has a crystallinity of about 5% to about 15%, or from about 9% to about 11%. The crystallinity may be determined by dividing the heat of fusion of a sample by the heat of fusion of a 100% crystalline polymer, which is assumed to be 189 J/g for isotactic homopolypropylene.

The elastomer component, optional propylene-based thermoplastic, and optional additives, as well as methods of processing the polymer composition, and nonwoven materials formed through such processes, are described in greater detail herein below.

Elastomer Component

The elastomer component is preferably a propylene-ethylene copolymer, more preferably a propylene-ethylene random copolymer having crystalline regions interrupted by non-crystalline regions. Not intended to be limited by any theory, it is believed that the non-crystalline regions may result from regions of non-crystallizable polypropylene segments and/or the inclusion of comonomer units. The crystallinity and the melting point of the propylene-based elastomer are reduced compared to highly isotactic polypropylene by the introduction of errors (stereo and region defects) in the insertion of propylene and/or by the presence of comonomer.

Preferably, however, the introduction of comonomer is limited to specific amounts, so as to maintain adequately high crystallinity of the copolymer for spunbond processing purposes. Thus, the copolymer preferably has an ethylene content of about 10 to about 14.5 wt %, or about 12 to about 14.5 wt %, or about 13 to about 14 wt %, the weight percentages based upon the total weight of the propylene-ethylene copolymer. Propylene-derived units form the balance of the copolymer of such embodiments (that is, the copolymer comprises about 85.5 to about 90 wt % propylene, or about 85.5 to about 88 wt %, or about 86 to about 87 wt %).

The propylene-ethylene copolymer has a melt flow rate (MFR) of about 30 g/10 min (dg/min) to about 80 g/10 min, or about 35 to about 55 g/10 min, or about 40 to about 50 g/10 min, or about 42 to about 47 g/10 min. The MFR is measured in accordance with ASTM D-1238 at 230° C. and 2.16 kg weight, which determination is described as of May 2015 in ASTM D1238-13, Standard Test Method for Melt Flow Rates of Thermoplastics by Extrusion Plastometer, ASTM International, West Conshohocken, Pa., 2013, available at www.astm.org, which is incorporated herein by reference.

The propylene-ethylene copolymer may have a single peak melting transition as determined by differential scanning calorimetry (DSC). In one embodiment, the copolymer has a primary peak transition of about 60° C. to about 70° C. (preferably about 60° C. to about 65° C.), with a broad end-of-melt transition of about 80° C. to about 105° C., such as about 85° C. to about 95° C., or about 88° C. to about 92° C. The peak "melting point" ("$T_m$") is defined as the temperature of the greatest heat absorption within the range of melting of the sample. However, the copolymer may show secondary melting peaks adjacent to the principal peak, and/or at the end-of-melt transition. For the purposes of this disclosure, such secondary melting peaks are considered together as a single melting point, with the highest of these peaks being considered the Tm of the copolymer. The propylene-ethylene copolymer may have a $T_m$ ranging from a low of any one of about 58, 59, 60, 61, 62, 63, 64, and 65° C., to a high of any one of about 62, 63, 64, 65, 66, 67, 68, 69, and 70° C., provided the high is greater than the low.

The method of determination by DSC is as follows: DSC data may be obtained using a Perkin-Elmer DSC 7. About 5 mg to about 10 mg of a sheet of the polymer to be tested should be pressed at approximately 200° C. to 230° C., then removed with a punch die and annealed at room temperature for 48 hours. The samples should then be sealed in aluminum sample pans. The DSC data should be recorded by first cooling the sample to −50° C. and then gradually heating it to 230° C. at a rate of 10° C./minute. Keep the sample at 230° C. for 10 minutes before a second cooling-heating cycle is applied. Both the first and second cycle thermal events should be recorded. The melting temperature is measured and reported during the second heating cycle (or second melt).

The DSC procedure may be continued to determine the heat of fusion and the degree of crystallinity of the polymer sample. The percent crystallinity (X %) should be calculated using the formula, X %=[area under the curve (Joules/gram)/B(Joules/gram)]*100, where B is the heat of fusion for the homopolymer of the major monomer component. These values for B may be found from the Polymer Handbook, Fourth Edition, published by John Wiley and Sons, New York 1999. A value of 189 J/g (B) is used as the heat of fusion for 100% crystalline polypropylene, the major component of the propylene-ethylene copolymer of various embodiments described herein.

The propylene-ethylene copolymer may have $H_f$ of about 17.5 to about 25 J/g, or about 18 to about 22 J/g, or about 19 to about 20 J/g. The propylene-ethylene copolymer may have a % crystallinity of about 5% to about 15%, or about 9% to about 11%, or about 10% to about 10.5%. $H_f$ and percent crystallinity are determined according to the DSC procedure as described above.

The propylene-ethylene copolymer may have a density of about 0.850 g/cm$^3$ to about 0.920 g/cm$^3$, or about 0.860 to about 0.890 g/cm$^3$, or about 0.860 to about 0.870 g/cm$^3$, at room temperature as measured per ASTM D-1505.

The propylene-ethylene copolymer may have a weight average molecular weight ("Mw") of about 100,000 to about 130,000 g/mole, or about 115,000 to about 125,000 g/mol. The propylene-ethylene copolymer may have a number average molecular weight ("Mn") of about 40,000 to about 60,000 g/mole, or about 50,000 to about 55,000 g/mol. The propylene-ethylene copolymer may have a z-average molecular weight ("Mz") of about 180,000 to about 200,000 g/mole, or about 185,000 to about 195,000 g/mol. The propylene-ethylene copolymer may have a molecular weight distribution MWD (defined as Mw/Mn) ranging from about 1.6 to about 3.25, or about 1.75 to about 2.25, or about 1.9 to about 2.1.

The propylene-ethylene copolymer may have a Shore A Hardness (as determined in accordance with ASTM D2240) of about 60 to about 80, or about 65 to about 75, or about 69 to about 72. The Vicat softening temperature of the propylene-ethylene copolymer (determined in accordance with ASTM D1525) may be about 40 to about 60° C., or about 48 to about 52° C., or about 49 to about 52° C.

Processes suitable for preparing the propylene-ethylene copolymer may in some embodiments include metallocene-catalyzed or Ziegler-Natta catalyzed processes, including solution, gas-phase, slurry, and/or fluidized bed polymerization reactions. Suitable polymerization processes are described in, for example, U.S. Pat. Nos. 4,543,399, 4,588,790; 5,001,205; 5,028,670; 5,317,036; 5,352,749; 5,405,922; 5,436,304; 5,453,471; 5,462,999; 5,616,661; 5,627,242; 5,665,818; 5,668,228; and 5,677,375; PCT publications WO 96/33227 and WO 97/22639; and European publications EP-A-0 794 200, EP-A-0 802 202 and EP-B-634 421, the entire contents of which are incorporated herein by reference.

In certain preferred embodiments, the propylene-ethylene copolymer is a reactor blend; that is, it is a blend of effluents from two or more polymerization reactor zones, such as parallel solution polymerization reactors, each zone including a metallocene-catalyzed polymerization process. Particularly suitable are those polymerization processes and reactors as described in U.S. Pat. Nos. 6,881,800 and 8,425,847, which are incorporated herein by reference.

Although propylene-ethylene copolymers are described above as the elastomer component, in some embodiments, the elastomer component may be a propylene-based elastomer having a comonomer in addition to ethylene, and/or having comonomer(s) different from ethylene, so long as the MFR, $T_m$, and crystallinity (or $H_f$) of the elastomer component remain within the ranges described above with respect to the propylene-ethylene copolymers. For instance, the elastomer component may be a propylene-α-olefin copolymer comprising units derived from propylene and one or more comonomer units derived from a $C_4$ to $C_{20}$ α-olefin in addition to, or instead of, ethylene. The propylene-α-olefin copolymer may optionally further comprise one or more comonomer units derived from dienes. In some embodiments, then, the α-olefin comonomer units may derive from, for example, 1-butene, 1-hexane, 4-methyl-1-pentene and/or 1-octene. In one or more embodiments, the diene comonomer units may derive from 5-ethylidene-2-norbornene, 5-vinyl-2-norbornene, divinyl benzene, 1,4-hexadiene, 5-methylene-2-norbornene, 1,6-octadiene, 5-methyl-1,4-hexadiene, 3,7-dimethyl-1,6-octadiene, 1,3-cyclopentadiene, 1,4-cyclohexadiene, dicyclopentadiene, or a combination thereof.

Propylene-Based Thermoplastic Polymer

The improved processability permitted by the elastomer component described herein advantageously allows for the use of little or no non-additive polymer in the polymer composition to be processed. Thus, in some embodiments, the polymer composition includes no propylene-based thermoplastic polymer. However, in yet other embodiments, a small amount of propylene-based thermoplastic polymer may be included in the polymer composition as a processing aid, such as 10 wt % or less of a propylene-based thermoplastic polymer. Preferably, the polymer composition comprises 3 wt % or less of the propylene-based thermoplastic polymer, such as 2 wt % or less, or 1 wt % or less.

Propylene-based thermoplastic polymers, which may also be referred to as propylene-based thermoplastic resins, include those polymers that primarily comprise units derived from the polymerization of propylene. In certain embodiments, at least 98% of the units of the propylene-based thermoplastic polymer derive from the polymerization of propylene. Preferably, the propylene-based thermoplastic polymer is a homopolymer of polypropylene (i.e., homopolypropylene).

The propylene-based thermoplastic polymers may have a melting temperature ($T_m$) that is greater than 120° C., or greater than 155° C., or greater than 160° C. In some embodiments, the propylene-based thermoplastic polymers may have a $T_m$ that is less than 180° C., or less than 170° C., or less than 165° C.

The propylene-based thermoplastic polymers may have a heat of fusion ($H_f$) that is equal to or greater than 80 J/g, or greater than 100 J/g, in or greater than 125 J/g, or greater than 140 J/g as measured by DSC.

In one or more embodiments, propylene-based thermoplastic polymers may include crystalline and semi-crystalline polymers. In one or more embodiments, these polymers may be characterized by a crystallinity of at least 40% by weight, or at least 55% by weight, or at least 65%, or at least 70% by weight as determined by DSC. Crystallinity may be determined by dividing the heat of fusion of a sample by the heat of fusion of a 100% crystalline polymer, which is assumed to be 189 J/g for isotactic polypropylene.

In general, the propylene-based thermoplastic polymers may be synthesized having a broad range of molecular weight and/or may be characterized by a broad range of MFR. For example, the propylene-based thermoplastic polymers can have an MFR of at least 2 dg/min, or at least 4 dg/min, or at least 6 dg/min, or at least 10 dg/min, where the MFR is measured according to ASTM D-1238, 2.16 kg @ 230° C. In some embodiments, the propylene-based thermoplastic polymer can have an MFR of less than 2,000 dg/min, or less than 400 dg/min, or less than 250 dg/min, or less than 100 dg/min, or less than 50 dg/min, where the MFR is measured according to ASTM D-1238, 2.16 kg @ 230° C.

The propylene-based thermoplastic polymers may have a Mw of from about 50 to about 2,000 kg/mole, or from about 100 to about 600 kg/mole. They may also have a Mn of from about 25 to about 1,000 kg/mole, or from about 50 to about 300 kg/mole, as measured by GPC with polystyrene standards.

In one embodiment, the propylene-based thermoplastic polymers include a homopolymer of a high-crystallinity isotactic or syndiotactic polypropylene. This polypropylene can have a density of from about 0.85 to about 0.91 g/cc, with the largely isotactic polypropylene having a density of from about 0.90 to about 0.91 g/cc. In one or more embodiments, the propylene based thermoplastic polymer includes isotactic polypropylene having a bimodal molecular weight distribution.

The propylene-based thermoplastic polymers may be synthesized by any appropriate polymerization technique known in the art such as, for example, slurry, gas phase, or solution, using catalyst systems such as conventional Ziegler-Natta catalysts or other single-site organometallic catalysts like metallocenes, or non-metallocenes.

Additives

The polymer compositions of some embodiments optionally include one or more additives. Any additive known to be suitable in a spunbonding process may be employed with the elastomer component.

In some preferred embodiments, any additives are present in the polymer composition in an amount of 10 wt % or less, or 6 wt % or less, such as 3 wt % or less. In various embodiments, the additive(s) are present in amounts less than or equal to 10, 9, 8, 7, 6, 5, 4, 3, 2, 1, and 0.5 wt %, the weight percentages being based upon the weight of the polymer composition.

In yet other embodiments, the polymer composition may include more than 10 wt % additive, such as up to 15, 20, 25, 30, 35, or 40 wt %. In general, any amount of additive known to be useful in a spunbonding process may be included in the polymer composition along with the elastomer component.

In some embodiments, useful additives include, nucleating agents, which can be present at 50 to 4000 ppm based on total polymer content in the polymer composition. Nucleating agents include, for example, sodium benzoate and talc. Also, other nucleating agents may also be employed, such as Ziegler-Natta olefin products or other highly crystalline polymers. Nucleating agents include Hyperform (such as HPN-68) and Millad additives (e.g., Millad 3988) (Milliken Chemicals, Spartanburg, S.C.) and organophosphates like NA-11 and NA-21 (Amfine Chemicals, Allendale, N.J.).

Other additives that may be used include, for example, stabilizers, antioxidants, fillers, and slip aids (or, alternatively, slip agents or slip additives). Primary and secondary antioxidants include, for example, hindered phenols, hindered amines, and phosphites. Other additives such as dispersing agents, for example, Acrowax C, can also be included. Catalyst deactivators may also be used including, for example, calcium stearate, hydrotalcite, and calcium oxide, and/or other acid neutralizers known in the art.

In one or more embodiments, useful slip aids include those compounds or molecules that are incompatible with the polymeric matrix of the fibers (i.e., the elastomer components) and therefore migrate to the surface of the fiber, once formed. In one or more embodiments, the slip aids form a monolayer over the surface (or a portion thereof) of the fiber. In these or other embodiments, useful slip aids are characterized by relatively low molecular weight, which can facilitate migration to the surface. Types of slip aids include fatty acid amides as disclosed in Handbook of Antiblocking, Release and Slip Additives, George Wypych, Page 23. Examples of fatty acid amides include, but are not limited to, behenamide, erucamide, N-(2-hdriethyl) erucamide, Lauramide, N,N'-ethylene-bis-oleamide, N,N'-ethylene bisstearmide, oleamide, oleyl palmitamide, stearyl erucamide, tallow amide, and mixtures thereof.

Other additives include, for example, fire/flame retardants, plasticizers, vulcanizing or curative agents, vulcanizing or curative accelerators, cure retarders, processing aids, and the like. The aforementioned additives may also include fillers and/or reinforcing materials, either added independently or incorporated into an additive. Examples include carbon black, clay, talc, calcium carbonate, mica, silica, silicate, combinations thereof, and the like. Other additives which may be employed to enhance properties include antiblocking agents or lubricants.

In yet other embodiments, isoparaffins, polyalphaolefins, polybutenes, or a mixture of two or more thereof may also be added to the compositions of the invention. Polyalphaolefins may include those described in WO 2004/014998, particularly those described at page 17, line 19 to page 19, line 25. These polyalphaolefins may be added in amounts such as about 0.5 to about 40% by weight, or from about 1 to about 20% weight, or from about 2 to about 10% by weight.

Any additive, may be included in the polymer composition in neat form, or as a masterbatch. When additives are present as a masterbatch, the % by weight of the additive masterbatch (that is, the wt % of the carrier resin-plus-additive) is taken as the amount of additive included in the polymer composition. Thus, where an additive is included in masterbatch form, 10 wt % of that additive would mean 10 wt % of the masterbatch (i.e., the combined amount of carrier resin and additive would be 10 wt %). Any suitable carrier resin may be used to form an additive masterbatch, such as polypropylene, polyethylene, propylene-ethylene copolymers, and the like.

Processing the Polymer Compositions

The formation of nonwoven fabrics from the foregoing polymer compositions may include manufacture of fibers by extrusion. The extrusion process may be accompanied by mechanical or aerodynamic drawing of the fibers. The fiber and fabrics of the present invention may be manufactured by any technique and/or equipment known in the art, many of which are well known. For example, spunbond nonwoven fabrics may be produced by spunbond nonwoven production lines produced by Reifenhauser GmbH & Co., of Troisdorf, Germany. The Reifenhauser system utilizes a slot drawing technique as described in U.S. Pat. No. 4,820,142.

More particularly, spunbond or spunbonded fibers include fibers produced, for example, by the extrusion of molten polymer filaments from either a large spinneret having several thousand holes or with banks of smaller spinnerets containing, for example, as few as 40 holes. The temperature at which the spinneret is operated (i.e., the "melt temperature" of the extruder) may range from about 180° C. to about 215° C., or from about 180° C. to about 200° C., or about 185° C. to about 195° C. That is, processes according to some embodiments may include extruding the polymer composition through a spinneret at a temperature ranging from about 180° C. to about 200° C., or from about 185° C. to about 195° C. Throughput preferably ranges from about 0.10 to about 0.30 ghm (gram/hole/min), or from about 0.15 to about 0.25 ghm.

After exiting the spinneret, the molten filaments are quenched by a cross-flow air quench system, then pulled away from the spinneret and attenuated (drawn) by high speed air. There are generally two methods of air attenuation, both of which use the Venturi effect. The first draws the filament using an aspirator slot (slot draw), which may run the width of the spinneret or the width of the machine. The second method draws the filaments through a nozzle or aspirator gun. Filaments formed in this manner may be collected on a collecting surface, such as a screen ("wire") or porous forming belt to form a web of cooled fibers. The web can then be passed through compression rolls and then between heated calendar rolls where raised lands on one or both rolls bond the web at points covering, for example, 10% to 40% of its area to form a nonwoven fabric (e.g., point-bonding). In another embodiment, welding of the deposited fibers can also be effected using convection or radiative heat. In yet another embodiment, fiber welding can be effected through friction by using hydro entangling or needle punch methods.

The fibers and/or webs may furthermore be annealed. Annealing may be carried out after the formation of fiber in continuous filament or fabrication of a nonwoven material from the fibers. Annealing may partially relieve the internal stress in the stretched fiber and restore the elastic recovery properties of the blend in the fiber. Annealing has been shown to lead to significant changes in the internal organization of the crystalline structure and the relative ordering of the amorphous and semicrystalline phases. This may lead to recovery of the elastic properties. For example, annealing the fiber at a temperature of at least 40° C., above room temperature (but slightly below the crystalline melting point of the blend), may be adequate for the restoration of the elastic properties in the fiber.

Thermal annealing of the fibers can be conducted by maintaining the fibers (or fabrics made from the fibers) at temperatures, for example, between room temperature up to 160° C., or alternatively to a maximum of 130° C. for a period between a few seconds to less than 1 hour. A typical annealing period is 1 to 5 minutes at about 100° C. The annealing time and temperature can be adjusted based upon the composition employed. In other embodiments, the annealing temperature ranges from 60° C. to 130° C., or may be about 100° C.

In certain embodiments, for example conventional continuous fiber spinning, annealing can be done by passing the fiber through a heated roll (godet) without the application of conventional annealing techniques. Annealing may desirably be accomplished under very low fiber tension to allow shrinking of the fiber in order to impart elasticity to the fiber. The above-referenced passing of fibers through heated calender rolls may accomplish such annealing steps. Similar to fiber annealing, the nonwoven web may desirably be formed under low tension to allow for shrinkage of the web in both machine direction (MD) and cross direction (CD) to enhance the elasticity of the nonwoven web. In other embodiments, the bonding calender roll temperature ranges from 35° C. to 85° C., or at a temperature of about 60° C. The annealing temperature can be adjusted for any particular blend. These calendar roll temperatures may be less than typically used due to the high concentration of the elastomer component (e.g., propylene-ethylene copolymer as described above) in the polymer composition being processed.

Nonwoven Materials

The nonwoven material resulting from the processing of various embodiments may be spunbond nonwoven material, e.g., a spunbond fabric or fiber. The spunbond material may exhibit hysteresis in either or both of the machine direction (MD) and cross direction (CD) in a second cycle of testing of less than or equal to 50%, 45%, 40%, 35%, 34%, 33%, 32%, 31%, or 30%. "Hysteresis" is defined and determined according to the description in the "Examples" section below for "hysteresis (%)." Hysteresis of such embodiments may also have a lower bound of at least any one of 20, 21, 22, 23, 24, 25, and 26%.

The nonwoven material may also exhibit permanent set (after 2 cycles of testing) of less than 10, 9, 8, 7, 6, or 5% (again, in either or both of the MD and CD), and greater than or equal to 0, 1, 2, 3, or 4%. The nonwoven material may further exhibit 50% unloading force, on $2^{nd}$ cycle and in either or both of MD and CD, of greater than or equal to 0.8, 0.9, 1.0, 1.1, 1.2, 1.3, 1.4, 1.5, 1.6, 1.7, 1.8, 1.9, 2.0, 2.3, 2.6, 3.0, 3.3, 3.6, 4.0, 4.3, 4.6, or 5.0 N/5 cm. The nonwoven material may also or instead exhibit a peak load of less than or equal to 25, 24, 23, 22, 21, 20, 19, 18, 17, 16, 15, 14, 13, 12, 11, or 10 N in the MD, and/or a peak load of less than or equal to 12, 11, 10, 9, 8, 7, 6, or 5 N in the CD. "Permanent set," "50% unloading force," and "Peak Load" are each defined and determined on a second cycle of hysteresis testing according to the description given below in the "Examples" section, in particular in the discussion of hysteresis testing.

Further, the nonwoven material may also exhibit superior tensile strength and elasticity, such as elongation at maximum strain of greater than or equal to 250%, or greater than or equal to 270%, or greater than or equal to 277%. The tensile strength of the nonwoven material may be such that the material can withstand a force of (that is, the breaking force of the nonwoven material may be) greater than or equal 18, 19, 20, 21, 22, 23, 24, 25, 26, 27, 28, 29, or 30 N in the MD. In the CD, the breaking force may be greater than or equal to 6, 7, 8, 9, 10, or 11 N.

Each of the aforementioned elasticity properties (i.e., permanent set, 50% unloading force, and hysteresis %), and each of the aforementioned tensile strength properties (i.e., breaking force, elongation at maximum strain) are measured on the basis of a nonwoven material having basis weight of about 25 to 100 gsm, or having any basis weight ranging from 35 to 75 gsm, or for a nonwoven material of about 35 gsm, of about 50 gsm, of about 65 gsm, of about 75 gsm, or about 100 gsm. In other embodiments, the elasticity properties may be determined on the basis of a nonwoven material having basis weight of any one of (i) 35 to 100 gsm; (ii) 35 to 50 gsm; (iii) 50 to 75 gsm; (iv) 50 to 100 gsm; and (v) 75 to 100 gsm). Unless clearly indicated otherwise, these basis weights in general are not intended to limit the nonwoven material to a particular basis weight, but instead to provide a basis for measuring the recited elasticity and tensile strength properties. Particular embodiments in which elasticity properties are determined for a nonwoven material having basis weight of about 35 gsm (or of about 35 gsm to about 50, 75, or 100 gsm) may exhibit, on a second cycle of hysteresis testing, one or more of: (i) hysteresis in either or both of the MD and CD of 40% or less; (ii) permanent set in either or both of the MD and the CD of 6% or less; (iii) 50% unloading force of 2.0 N/5 cm or greater in the MD, and/or 0.9 N/5 cm in the CD; and (iv) peak load of 10 N or less in the MD, and/or 5 N or less in the CD. In addition, particular embodiments in which elasticity properties are determined for a nonwoven material having basis weight of about 100 gsm (or of about 75 gsm to 100 gsm) may exhibit, on a second cycle of hysteresis testing, one or more of: (i) hysteresis in either or both of the MD and CD of 40% or less; (ii) permanent set in either or both of the MD and the CD of 6% or less; (iii) 50% unloading force of 2.5 N/5 cm or greater in the MD, and/or 1.5 N/5 cm or greater in the CD; and (iv) peak load of 20 N or less in the MD, and/or 12 N or less in the CD.

Aside from the aforementioned measurement function of basis weights, nonwoven materials according to some embodiments may have a basis weight ranging in general from 15 gsm to 125 gsm. The basis weight of some embodiments may range from a low of any one of 15, 20, 25, 30, 35, 40, 45, and 50 gsm, to a high of any one of 30, 35, 40, 45, 50, 55, 60, 65, 70, 75, 80, 85, 90, 95, 100, 105, 110, 115, 120, and 125 gsm, provided that the high end of the range is greater than the low end. Of course, any of these nonwoven materials having a particular basis weight may exhibit the elasticity properties associated with that basis weight, as described previously. For instance, a nonwoven material having basis weight of 35 gsm may exhibit one or more of the elasticity properties that are determined on the basis of a nonwoven material having basis weight of 35 gsm.

Composites

The spunbond materials of various embodiments may form a nonwoven fabric layer of a multilayer composite. For instance, the spunbond material may, during its processing or after processing, be combined with one or more layers of other woven or nonwoven material, such as one or more other spunbond layers, one or more meltblown layers, and the like, to form a composite. Suitable composites include S, SS, SSS, SMS, MSM, $MS_xM$, $SM_xS$, SMM, MMS, and the like, where each S represents a spunbond layer in the composite, and each M represents a meltblown layer in the composite (with each sub-script x representing an integer from 1-10, indicating repetition of the labeled layer). The spunbond material described hereinabove may form any one or more of the spunbond layers in the composites of such embodiments.

Another example is an SSMMS construction, wherein the outer S substrate may be a bi-component stretch laminate (for example, PE sheath/PP core), the inner S may be an elastic nonwoven web, the meltblown (M) layers may comprise one or more crystalline polyolefins (PP, PE), propylene-based elastomers, and blends thereof, and the outer S layer may comprise a bi-component web with an elastic nonwoven core and a polyolefin sheath. The elastic nonwovens may further be modified by any suitable additives known to those skilled in the art, such as titanium dioxide to improve opacity Spunbond Articles The fibers and nonwoven fabrics of the present invention may be employed in several applications. In one or more embodiments, they may be advantageously employed in diapers and/or similar personal hygiene articles, for example in such applications as diaper tabs, side panels, leg cuffs, top sheet, back sheet, tapes, feminine hygiene articles, swim pants, infant pull up pants, incontinence wear components, and bandages. In particular, they can be employed as the dynamic or stretchable components of these articles such as, but not limited to, the elastic fastening bands. In other embodiments, the fibers and nonwoven fabrics may be fabricated into other protective garments or covers such as medical gowns or aprons, surgical drapes, sterilization wraps, wipes, bedding, or similar disposable garments and covers. These materials may also find applications in protective covers, home furnishing such as bedding, carpet antiskid padding, wall coverings, floor coverings, window shades, scrims, and any other application in which traditional fabrics have been used previously.

In other embodiments, the fibers and fabrics of the present of the present invention can be employed in the manufacture of filtration media (gas and liquid). For example, particular applications include use in functionalized resins where the nonwoven fabric can be electrostatically charged to form an electret.

Further, the fibers and fabrics of the present invention may be employed in any of the structures and other end-use applications, or in conjunction with any of the additives and other compositions described in U.S. Pat. Nos. 7,902,093; 7,943,701; and 8,728,960.

EXAMPLES

In order to demonstrate the practice of the present invention, the following examples have been prepared and tested.

Example 1 (Comparative)

Example 1 is a comparative example, demonstrating the processing of a polymer composition (and articles formed therefrom) comprising an elastomer component that has lower MFR and higher ethylene content as compared to elastomer components of the present invention.

The polymer compositions of Example 1 were prepared with (i) "Copolymer A" (as the elastomer component); (ii) a homopolypropylene; and (iii) a slip additive masterbatch containing erucamide. Copolymer A was a propylene-ethylene copolymer that had the following typical properties: a density of 0.863 g/cm$^3$ (ASTM D1505), a MFR of 20 g/10 min (ASTM D-1238, 2.16 kg weight @ 230° C.), an ethylene content of 15.0 wt %, Shore A of 66 (ASTM D2240), a $H_f$ of 15.7 J/g, and a Vicat Softening temperature of 47.2° C. Copolymer A was produced using a metallocene catalyst in parallel solution polymerization reactors as described herein. The homopolypropylene used was HF1500, which is a homopolypropylene having an ultra-high MFR of about 1500 g/10 min. HF1500 is commercially available from Hunan Shengjin Chemical Company, Hunan, China.

As shown in Table 1, 3 wt % slip additive masterbatch was used in each of the three polymer compositions tested, while varying amounts of the Copolymer A and homopolypropylene were used. Table 1 also shows the calculated MFR of the polymer compositions (i.e., the blend of Copolymer A, HF1500, and slip additive MB). The calculated MFR reflects the behavior of the polymer blend composition as a whole, and can be calculated according to the relationship: $\ln(MFR)_{blend}=w_1 \ln(MFR_1)+w_2 \ln(MFR_2) \ldots +w_i (MFR_i)$, where the subscripts 1, 2, and i represent the respective blend components (for i blend components), and w is the weight fraction of each component in the blend. See Harris, E. K., *J. Appl. Polym. Sci.* 1973, 17, pp. 1679-1692, and in Bird et al., Dynamics of Polymeric Liquids, in *Fluid Mechanics*, Vol. 1, p. 147 (Wiley, 2nd Ed. 1987). For purposes of the Examples herein, the slip additive MB is a 20% erucamide in PP carrier resin masterbatch, with MFR of approximately 36 g/10 min.

TABLE 1

Comparative Polymer Compositions

| Sample ID | Copolymer A wt % | HF1500 wt % | Slip Additive MB wt % | Polymer Composition Calculated MFR |
|---|---|---|---|---|
| 1-1 | 70 | 27 | 3 | 65 |
| 1-2 | 80 | 17 | 3 | 42 |
| 1-3 | 90 | 7 | 3 | 28 |

Each polymer composition of Table 1 was formed into spunbond fabric samples using a conventional spunbond process with a single 1.6 m wide spinning beam having 5628 holes/m, 0.5 mm hole size. There was also an attempt to make spunbond fabrics utilizing pure Copolymer A, however, satisfactory spinnability could not be established at 200-245° C. melt temperature at the spinneret due to excessive tackiness of the polymer. Therefore, ultra high MFR polypropylene was used in the blend formulation Samples 1-1, 1-2, and 1-3 in order to attempt to satisfactorily spin compositions containing Copolymer A.

Sample 1-1 was extruded at a melt temperature of 221° C. at the spinneret; Sample 1-2 was extruded at a melt temperature of 230° C. at the spinneret; and Sample 1-3 was extruded at a melt temperature of 228° C. at the spinneret. However, it was found that even Sample 1-3 (containing 90 wt % Copolymer A) could not be satisfactorily run through the spunbonding process. In particular, spinning instability and die hole plugging required shutting down the process after less than 30 minutes. Thus, although some small amount of sample could be recovered, the required shutdown in under 30 minutes indicates that Sample 1-3 was unsuitable for commercial spunbond processing.

Fabric samples of Samples 1-1 and 1-2 were each collected onto a collecting belt with suction beneath the belt, then passed through a pair of heated rolls (one smooth, one embossed) for annealing/bonding. Key spinning and bonding parameters are set forth below in Table 2. The samples were formed into fabrics of varying basis weight, as also shown in Table 2.

TABLE 2

| Spunbond Parameters for Example 1 | | | | | | |
|---|---|---|---|---|---|---|
| Sample ID | Quench Air Temp. (° C.) | Quench Air (rpm) | Suction Blow (rpm) | Smooth Roll Temp. (° C.) | Emboss Roll Temp. (° C.) | Basis Weight (gsm) |
| 1-1 | 13 | 1200 | 968 | 101 | 101 | 70 |
| 1-2 | 13 | 1050 | 850 | 86 | 87 | 100 |

Tensile Testing: The fabric samples were tested according to the test method WSP 110.4 (dry process), Option B, as set forth by Integrated Paper Services, Inc. as of May 2015. A fabric sample with dimensions of 50 mm (5 cm) width and 200 mm (20 cm) length was stretched at a speed of 100 mm/min until broken. The peak load at break ("peak load") and the elongation at break (up to 277% elongation) data, together with the strain and stress curves, were recorded. "Breaking Force" is the force exerted to extend the sample at the point at which the sample breaks (or at the point at which the sample reaches the test's maximum elongation of 277%). "Elongation at break," similarly, is the elongation of the sample at the point at which it breaks. If the sample did not break through the testing range, its elongation at break was recorded as >277%.

Tensile strength properties were determined in both the machine direction (MD) and the cross direction (CD) of each fabric sample, and are reported in Table 3.

TABLE 3

| Tensile Strength of Example 1 Fabrics | | | | | |
|---|---|---|---|---|---|
| | Fiber | MD Tensile Properties | | CD Tensile Properties | |
| Sample ID | Size (μm) | Breaking Force (N) | Elongation at Max (%) | Breaking Force (N) | Elongation at Max (%) |
| 1-1 | 19 | 70 | 188 | 44 | 199 |
| 1-2 | 24 | 43 | 252 | 32 | >277 (no break) |

Hysteresis testing: Hysteresis tests were carried out as follows. Test samples measuring 150 mm length×50 mm width were stretched to 100% elongation at a cross-head speed of 500 mm/min. At the point of 100% elongation, the samples were held for 1 second before being allowed to return to the starting position, also at a speed of 500 mm/min. The samples were then held in the un-stretched position for 30 seconds, and the elongation cycle was repeated a second time. During the second cycle, the percent elongation reached at a load of 0.1N was measured. The test was conducted at 20° C. and 50% relative humidity. The extension of the sample was plotted against the load (force) applied to stretch the sample through each cycle, generating a hysteresis curve. From the hysteresis curve, one can also determine peak load (N), 50% unloading force (N/5 cm) (also referred to as retractive force at 50%), permanent set, and hysteresis (%). The hysteresis properties of each fabric sample can be tested in either the machine direction (MD) or cross direction (CD).

FIG. 1 is a generic model hysteresis curve provided for purposes of illustrating the determination of hysteresis data herein. As shown in FIG. 1, the first cycle provides data to generate the curve OACD. The second cycle provides data to generate the curve EBCD'.

"Peak load" is the force exerted upon the sample when it is at maximum elongation during the hysteresis testing. In FIG. 1, the peak load is the Y-axis value at point A.

"50% unloading force" is the force per width of sample (N/5 cm) exerted by a sample at 50% elongation, measured as the sample retracts from 100% elongation during the first hysteresis cycle. In FIG. 1, the 50% unloading force is the Y-value at point H.

"Permanent set" quantifies the increase in length experienced by the sample after completion of the first cycle of extension and relaxation, representing how much the sample has been permanently stretched as a result of the first extension and relaxation cycle. With reference to FIG. 1, it can be seen that as all force is removed after the first cycle, the extension of the sample does not return to 0; instead, it lies at a point D. The permanent set can be determined by dividing the line OD by the line OF (representing the maximum extension of the sample during testing), and multiplying by 100%. That is, with reference to FIG. 1, permanent set is (OD/OF)×100%.

"Hysteresis (%)" is defined as the quotient of hysteresis divided by mechanical hysteresis. Hysteresis and mechanical hysteresis are determined from the hysteresis curve. With reference to FIG. 1, hysteresis (%) may be determined as the area defined by curve OACD, divided by the area defined by OAFO, multiplied by 100%. That is, with reference to FIG. 1, hysteresis (%) is (OACD/OAFO)×100%.

Figure 2:
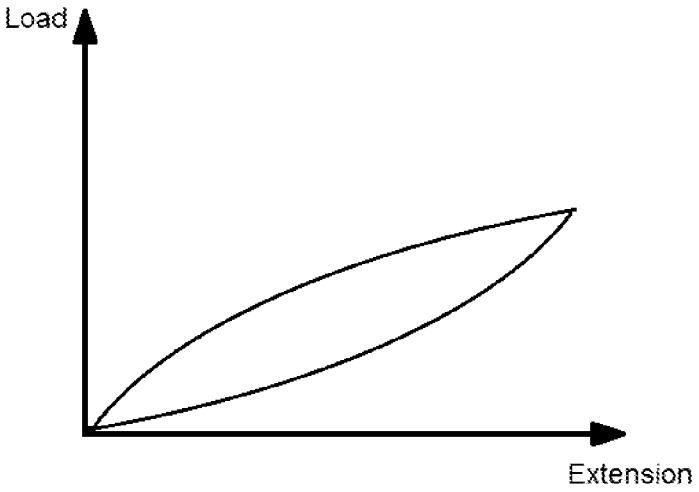
FIG. 2 is an illustration of an ideal hysteresis curve.

For visual reference regarding hysteresis, FIG. 2 illustrates an ideal hysteresis curve for elastic materials, indicating an approximate conformity to Hooke's law (and illustrating a return of the elastic material to its original length upon removal of the strain, that is, a permanent set of 0%). Desirably, for a given basis weight, a nonwoven will exhibit a combination of (i) low hysteresis; (ii) low permanent set; (iii) high 50% unloading force; and (iv) low peak load; all properties being determined in the 2nd cycle of hysteresis testing.

Figure 3A:
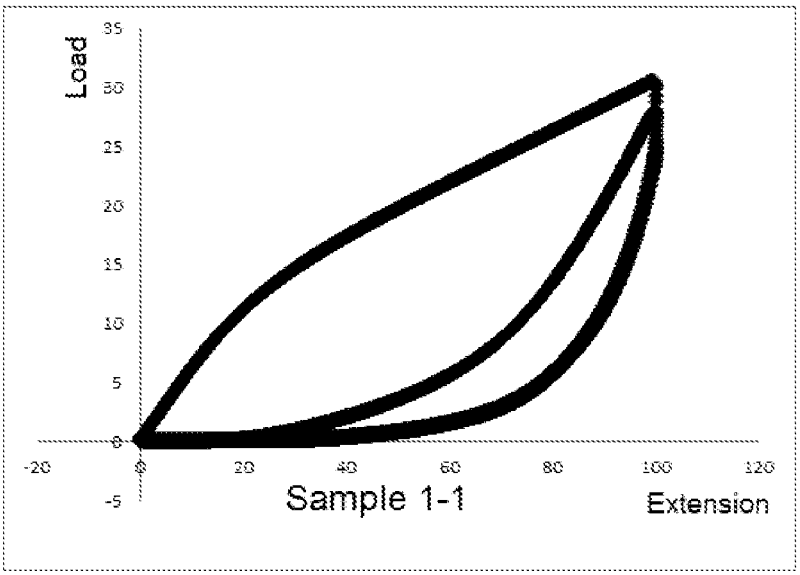
FIGS. 3*a* and 3*b* are plots of the load displacement hysteresis curves for a spunbond fabric of Sample 1-1 of Example 1 in the CD and MD, respectively.
Figure 3B:
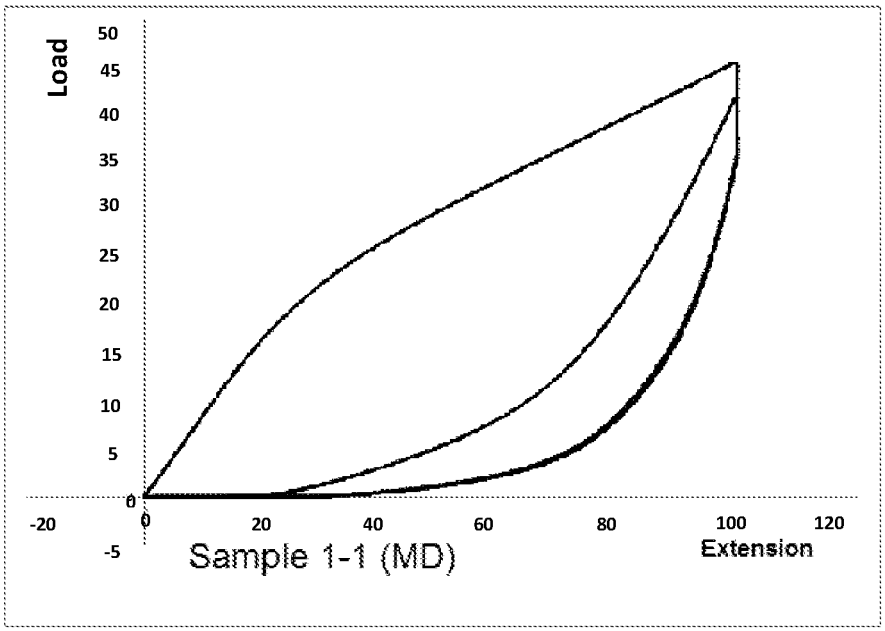
Figure 3C:
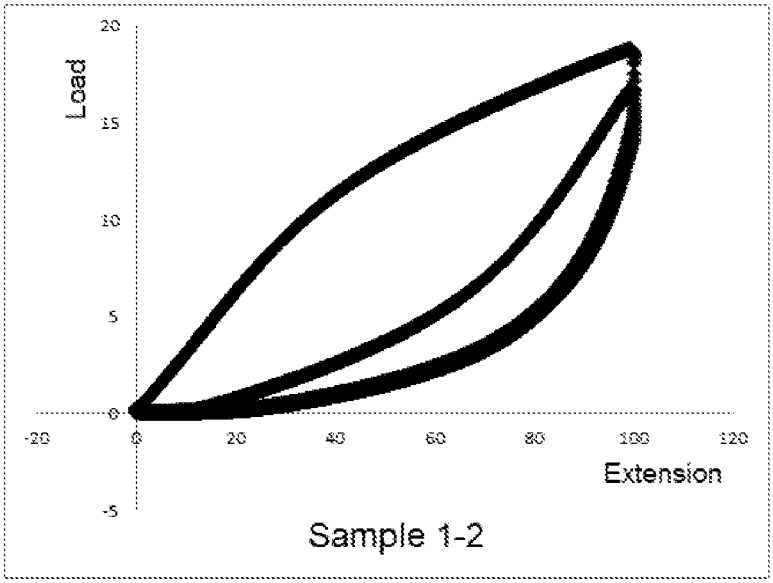
FIGS. 3*c* and 3*d* are plots of the load displacement hysteresis curves for a spunbond fabric of Sample 1-2 in Example 1 in the CD and MD, respectively.
Figure 3D:
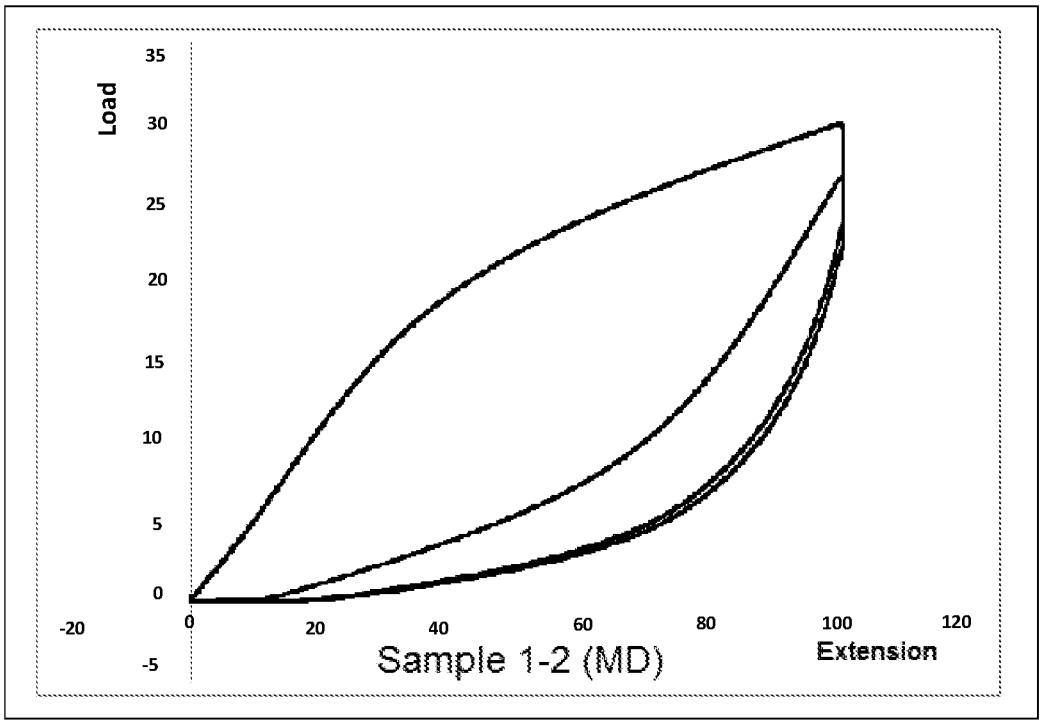

Table 4 reports the hysteresis data for each sample according to Comparative Example 1, and FIGS. 3*a* and 3*b* illustrate the load displacement curve for Sample 1-1 in the CD and MD, respectively. FIGS. 3*c* and 3*d* illustrate the load displacement curve for Sample 1-2 in the CD and MD, respectively.

TABLE 4

| Hysteresis of Example 1 Fabrics | | | | | | | | |
|---|---|---|---|---|---|---|---|---|
| | MD $2^{nd}$ Cycle Elasticity | | | | CD $2^{nd}$ Cycle Elasticity | | | |
| Sample ID | Peak Load (N) | Hysteresis (%) | Permanent Set (%) | 50% unloading (N/5 cm) | Peak Load (N) | Hysteresis (%) | Permanent Set (%) | 50% unloading (N/5 cm) |
| 1-1 | 38 | 52.3 | 28.4 | 1.2 | 26 | 52.3 | 19.4 | 0.86 |
| 1-2 | 25 | 48.7 | 18.6 | 2.0 | 16 | 47.3 | 18.4 | 1.52 |

Example 2 (Inventive)

Example 2 demonstrates the processing of a polymer composition (and articles formed therefrom) according to the present invention, The polymer compositions of Example 2 were prepared with a propylene-ethylene copolymer elastomer "Copolymer B" mixed with 3 wt % of an erucamide slip masterbatch (20 wt % erucamide in a polypropylene carrier resin, the same masterbatch used in Example 1 polymer compositions), and further optionally mixed with 3 wt % PP3155 homopolypropylene (in the case of samples 2-2 and 2-3), as shown in Table 5. Table 5 also indicates the calculated total MFR of each polymer composition.

Copolymer B was a propylene-ethylene copolymer that was produced as a reactor blend in parallel solution polymerization reactors using a metallocene catalyst as described herein. Copolymer B contained about 13 wt % ethylene and had the following properties: MFR of 48 g/10 min (ASTM D-1238, 2.16 kg weight @ 230° C.), density of 0.865 g/cm$^3$ (determined according to ASTM D-1505), Shore A Hardness (ASTM D-2240) of 71, Vicat Softening (ASTM D-1525) of 51° C., $H_f$ of 19.5 J/g, and crystallinity of 10%. PP3155 was a homopolypropylene having a MFR of 36 g/10 min (ASTM D-1238, 2.16 kg weight @ 230° C.), and is commercially available from ExxonMobil Chemical Company, Baytown, Tex.

TABLE 5

Inventive Polymer Compositions

| Sample ID | Copolymer B wt % | PP3155 wt % | slip additive MB wt % | Polymer Composition Calculated MFR |
|---|---|---|---|---|
| 2-1 | 97 | 0 | 3 | 48 |
| 2-2 | 94 | 3 | 3 | 47 |
| 2-3 | 94 | 3 | 3 | 47 |

Each of the inventive polymer compositions was formed into spunbond fabric samples using a conventional spunbond process with a single 3.2 m wide spinning beam, having 6000 holes/m, 0.42 mm hole size. The extruder was operated at a spinneret melt temperature of 190° C., as indicated in Table 6, which is well below the 221° C.–230° C. required for operation of the extruder of the comparative polymer compositions of Example 1. Table 6 indicates other parameters related to the operation of the spunbonding process in Example 2. The basis weight was determined according to WSP 130.1 (05), as promulgated by International Paper Services, Inc.

TABLE 6

Spunbond Parameters for Inventive Example 2

| Sample ID | Throughput (ghm) | Melt Temp. (° C.) | Quench Air (rpm) | Quench Air Temp. (° C.) | Suction Blow (rpm) | Basis Weight (gsm) |
|---|---|---|---|---|---|---|
| 2-1 | 0.17 | 190 | 600 | 12 | 900 | 75 |
| 2-2 | 0.17 | 190 | 600 | 12 | 900 | 75 |
| 2-3 | 0.17 | 190 | 600 | 12 | 900 | 50 |

Figure 4A:
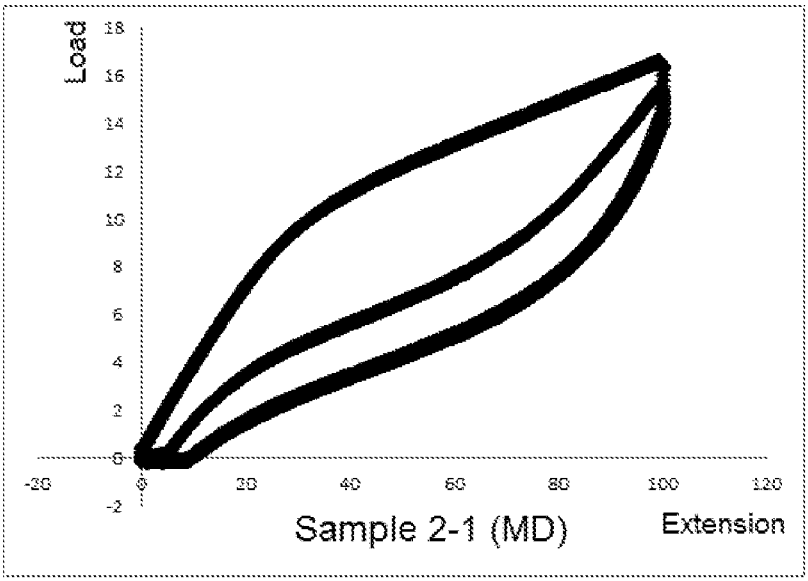
FIGS. 4*a* and 4*b* are plots of the force exerted on spunbond fabrics of Sample 2-1 of Example 2 vs. the extension of those samples through two cycles of extension and retraction for hysteresis testing, in the MD and the CD, respectively.
Figure 4B:
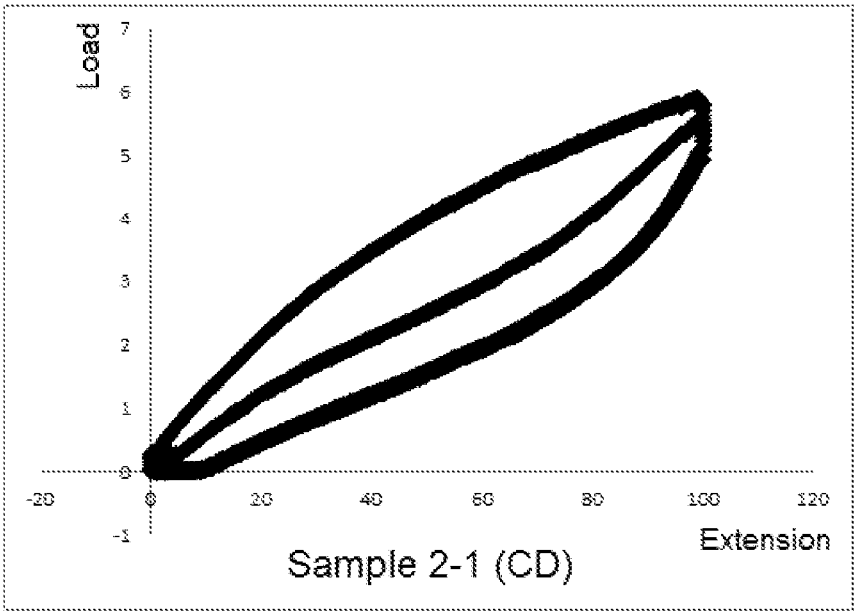
Figure 5A:
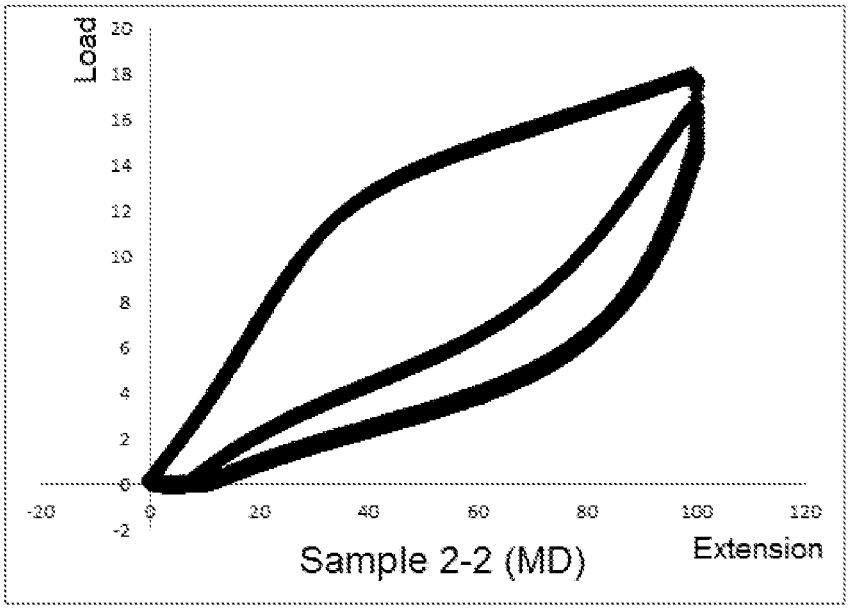
FIGS. 5*a* and 5*b* are plots of the force exerted on spunbond fabrics of Sample 2-2 of Example 2 vs. the extension of those samples through two cycles of extension and retraction for hysteresis testing, in the MD and the CD, respectively.
Figure 5B:
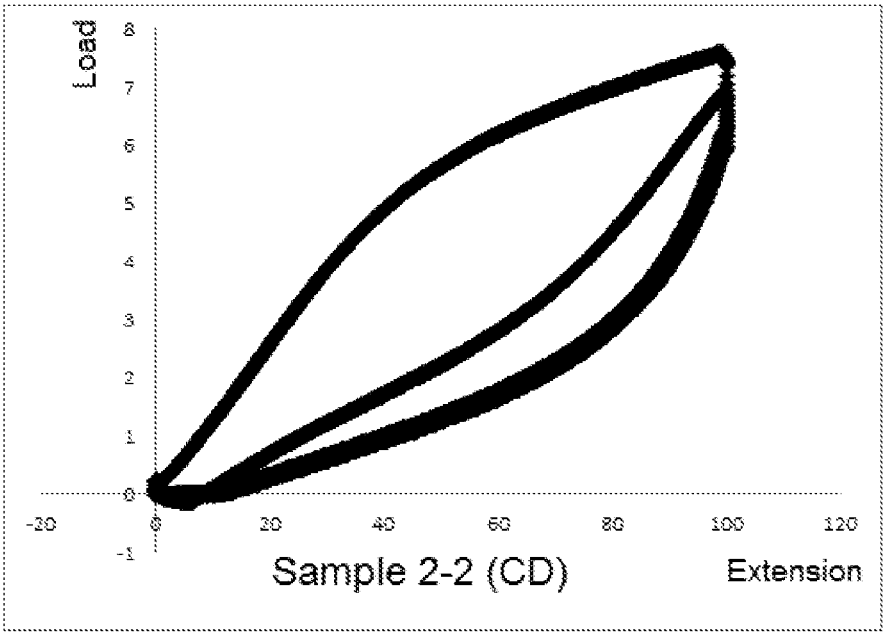
Figure 6A:
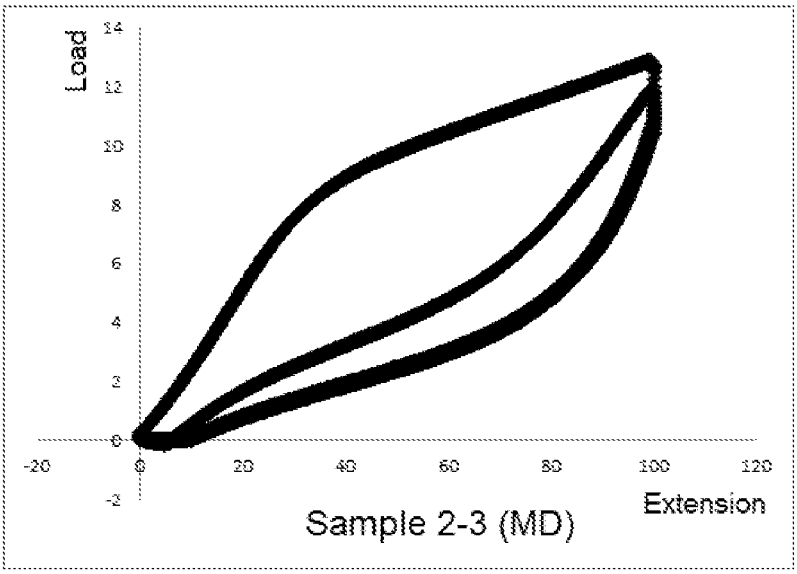
FIGS. 6*a* and 6*b* are plots of the force exerted on spunbond fabrics of Sample 2-3 of Example 2 vs. the extension of those samples through two cycles of extension and retraction for hysteresis testing, in the MD and the CD, respectively.
Figure 6B:
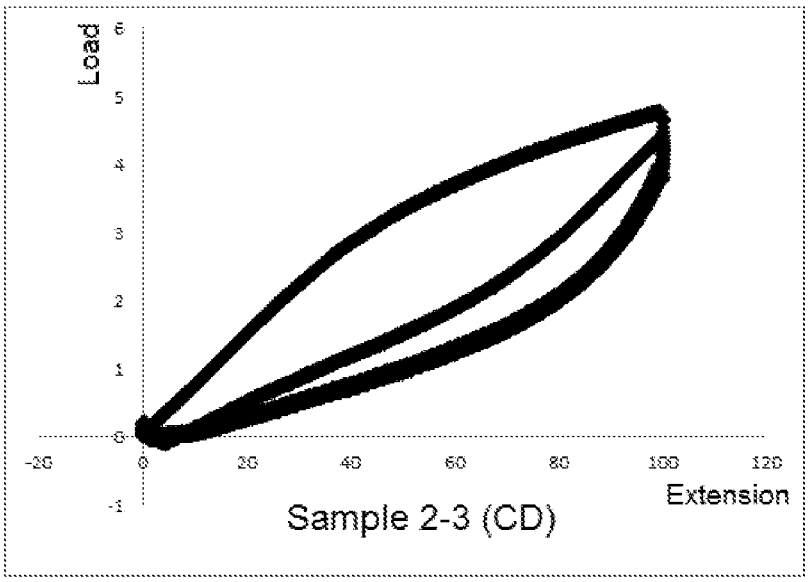

Tensile strength was determined using the same method described above with respect to Example 1, and is reported for Example 2 samples in Table 7. Hysteresis values (hysteresis (%), permanent set, 50% unloading force) were determined in the same manner as described above for Example 1, and such values are reported for Example 2 samples in Tables 8a and 8b below (for both 1$^{st}$ and 2$^{nd}$ cycle hysteresis testing). In addition, the load displacement curves used in determination of the hysteresis values for Example 2 samples are illustrated in FIGS. 4*a* and 4*b* (hysteresis for Sample 2-1 in the MD and CD, respectively); FIGS. 5*a* and 5*b* (hysteresis curves for Sample 2-2 in the MD and CD, respectively); and FIGS. 6*a* and 6*b* (hysteresis curves for Sample 2-3 in the MD and CD, respectively).

TABLE 7

Tensile Strength of Example 2 Fabrics

| | Fiber | MD Tensile Properties | | CD Tensile Properties | |
|---|---|---|---|---|---|
| Sample ID | Size (μm) | Breaking Force (N) | Elongation at Max (%) | Breaking Force (N) | Elongation at Max (%) |
| 2-1 | 30.7 | 31.0 | >277 (no break) | 10.3 | >277 (no break) |
| 2-2 | 30.7 | 29.3 | >277 (no break) | 11.8 | >277 (no break) |
| 2-3 | 29.2 | 19.9 | >277 (no break) | 6.5 | >277 (no break) |

The samples of Example 2 exhibited an improvement over the tensile properties of Example 1. That is, as seen in Table 7, none of the Example 2 sample nonwoven fabrics broke in either the MD or CD direction when extended to maximum elongation (277%), whereas all fabric samples of Example 1 broke in the MD direction, and only 2 survived breakage in the CD direction. In addition, the nonwoven fabrics of Example 2 required less force to extend the fabrics to 277% elongation (31, 29.3, and 19.9 N in the MD; 10.3, 11.8, and 6.5 N in the CD) as compared to the Example 1 samples (70 and 43 N in the MD; 44 and 32 N in the CD). This demonstrates the superior elasticity of the Example 2 fabrics as compared to those of Example 1. Thus, the compositions of Example 2 were easier to spin into fabrics than those of Example 1 and were able to be made at lower melt temperatures. Further, the fabrics of Example 2 exhibited superior tensile strength and elasticity, while also having decreased basis weight as compared to Sample 1-2.

TABLE 8a

Hysteresis of Example 2 Fabrics (1st cycle)

| | MD 1st Cycle Elasticity | | | | CD 1st Cycle Elasticity | | | |
|---|---|---|---|---|---|---|---|---|
| Sample ID | Peak load (N) | Hysteresis (%) | Permanent Set (%) | 50% unloading force (N/5 cm) | Peak load (N) | Hysteresis (%) | Permanent Set (%) | 50% unloading force (N/5 cm) |
| 2-1 | 16.1 | 55.9 | 9.1 | 4.4 | 6.3 | 49.7 | 10.4 | 1.7 |
| 2-2 | 17.8 | 66.7 | 11.2 | 3.3 | 7.7 | 64.2 | 13.5 | 1.5 |
| 2-3 | 12.6 | 64.2 | 10.2 | 2.5 | 4.4 | 12.3 | 12.3 | 1.0 |

TABLE 8b

Hysteresis of Example 2 Fabrics (2nd cycle)

| | MD 2nd Cycle Elasticity | | | | CD 2nd Cycle Elasticity | | | |
|---|---|---|---|---|---|---|---|---|
| Sample ID | Peak Load (N) | Hysteresis (%) | Permanent Set (%) | 50% unloading force (N/5 cm) | Peak Load (N) | Hysteresis (%) | Permanent Set (%) | 50% unloading force (N/5 cm) |
| 2-1 | 15.2 | 32.1 | 5.6 | 4.3 | 6.0 | 26.9 | 2.4 | 1.7 |
| 2-2 | 16.8 | 38.2 | 4.3 | 3.2 | 7.2 | 38.1 | 3.0 | 1.3 |
| 2-3 | 11.8 | 35.4 | 3.4 | 2.5 | 4.1 | 31.6 | 0.0 | 0.9 |

As shown by Tables 8a and 8b, the inventive fabrics of Example 2 demonstrate improved permanent set, and generally improved (or at least acceptable) hysteresis values—while still being significantly easier to process (and being formed with less polypropylene in the polymer composition as compared to Example 1 samples). This is a particularly surprising result given the slightly different spunbonding lines on which the Example 1 samples and the Example 2 samples, respectively, were processed. In particular, the Example 1 samples were processed on a spunbond line having fewer holes/m (5628 vs. 6000) and larger hole size (0.5 mm vs. 0.42 mm) than those of Example 2. One would typically expect the Example 1 fabrics to exhibit more elasticity, as they were processed on spunbonding equipment more suited for making elastic fabrics. Yet, the Example 2 samples nonetheless provide improved elasticity.

Example 3 (Inventive)

Example 3 further demonstrates the processing of a polymer composition and additional articles formed therefrom, both in accordance with the present invention. The polymer compositions of this Example 3 were prepared from the same Copolymer B and erucamide slip additive as used in Example 2; this time, however, no homopolypropylene was present in the blend, as shown in Table 9. Calculated MFR for the entire blend was determined in the same manner as described above respecting Examples 1 and 2.

TABLE 9

Additional Inventive Polymer Compositions

| Sample ID | Copolymer B wt % | PP wt % | slip additive MB wt % | Polymer Composition Calculated MFR |
|---|---|---|---|---|
| 3-1 | 97 | 0 | 3 | 48 |
| 3-2 | 97 | 0 | 3 | 48 |
| 3-3 | 97 | 0 | 3 | 48 |
| 3-4 | 97 | 0 | 3 | 48 |

Each of the Example 3 compositions was formed into spunbond fabric samples using a conventional spunbond process with a single 2.4 m wide spinning beam, having 4333 holes/m, 0.45 mm hole size. The extruder was operated at a spinneret melt temperature of 215° C., slightly cooler than the 221° C.-230° C. required for operation of the extruder of polymer compositions of comparative Example 1. Although this is higher than the temperature required for the other inventive Example 2, none of the Example 3 polymer compositions included any propylene-based thermoplastic in the blend. Further, after extrusion and deposition, the processing of Samples 3-1, 3-2, and 3-3 further included passing through smooth and emboss rolls. Sample 3-4 was not further bonded in this manner. Table 10 indicates the various parameters related to the operation of the spunbonding process of Example 3.

TABLE 10

Spunbond Parameters for Inventive Example 3

| Sample ID | Throughput (ghm) | Melt Temp. (° C.) | Quench Air T (° C.) | Quench Air rpm | Suction blow rpm | Smooth Roll T (° C.) | Emboss Roll T (° C.) | Basis Weight (gsm) |
|---|---|---|---|---|---|---|---|---|
| 3-1 | 0.24 | 215 | 12 | 900 | 850 | 60 | 63 | 35 |
| 3-2 | 0.24 | 215 | 12 | 900 | 850 | 60 | 63 | 65 |
| 3-3 | 0.24 | 215 | 12 | 900 | 850 | 60 | 63 | 100 |
| 3-4 | 0.24 | 215 | 12 | 900 | 850 | — | — | 100 |

Figure 7A:
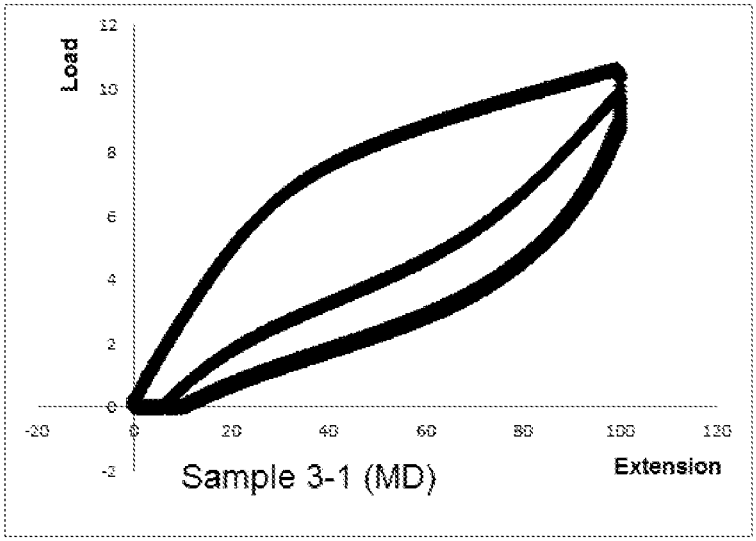
FIGS. 7*a* and 7*b* are plots of the force exerted on spunbond fabrics of Sample 3-1 of Example 3 vs. the extension of those samples through two cycles of extension and retraction for hysteresis testing, in the MD and the CD, respectively.
Figure 7B:
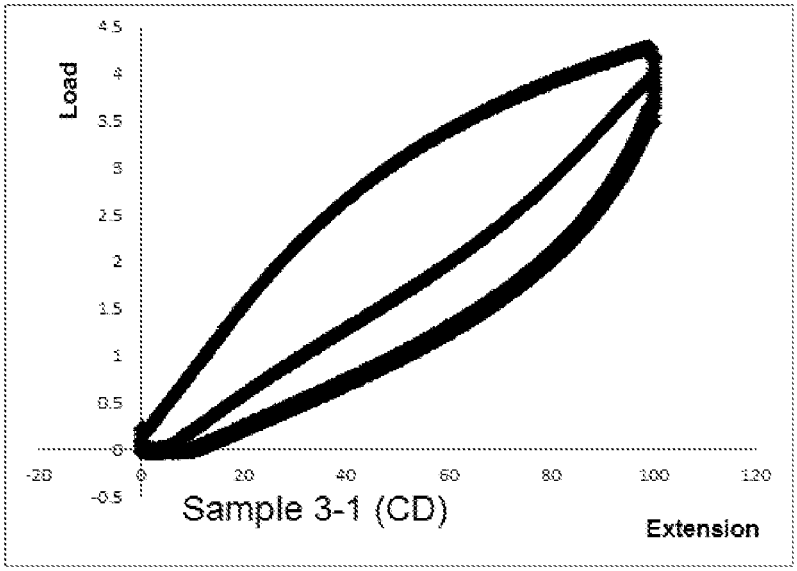
Figure 8A:
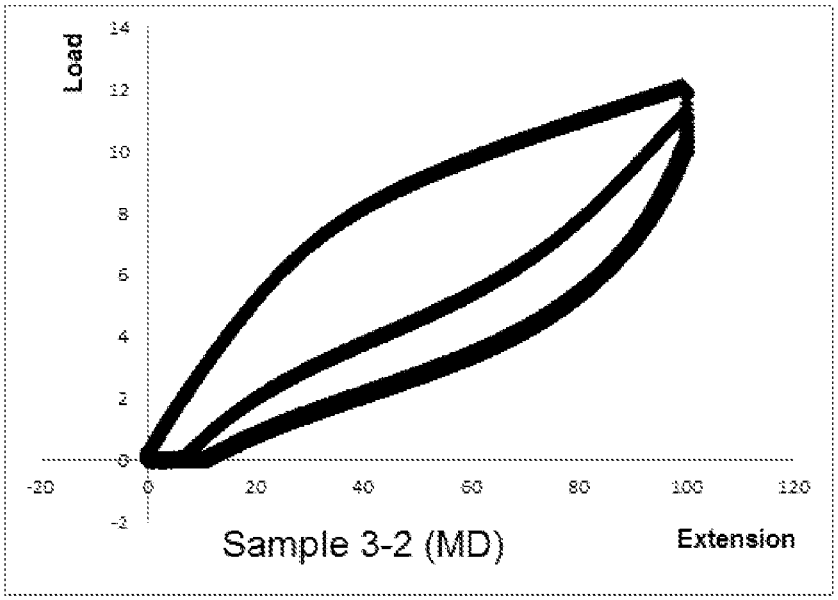
FIGS. 8*a* and 8*b* are plots of the force exerted on spunbond fabrics of Sample 3-2 of Example 3 vs. the extension of those samples through two cycles of extension and retraction for hysteresis testing, in the MD and the CD, respectively.
Figure 8B:
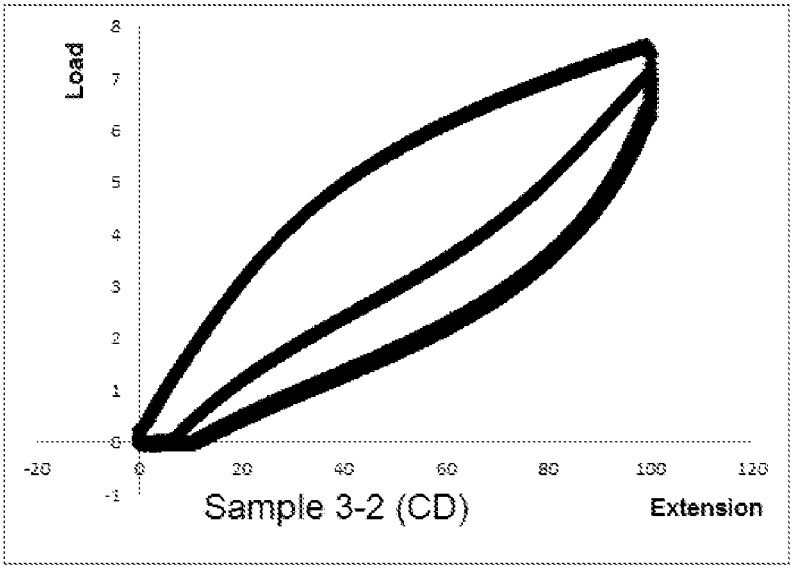
Figure 9A:
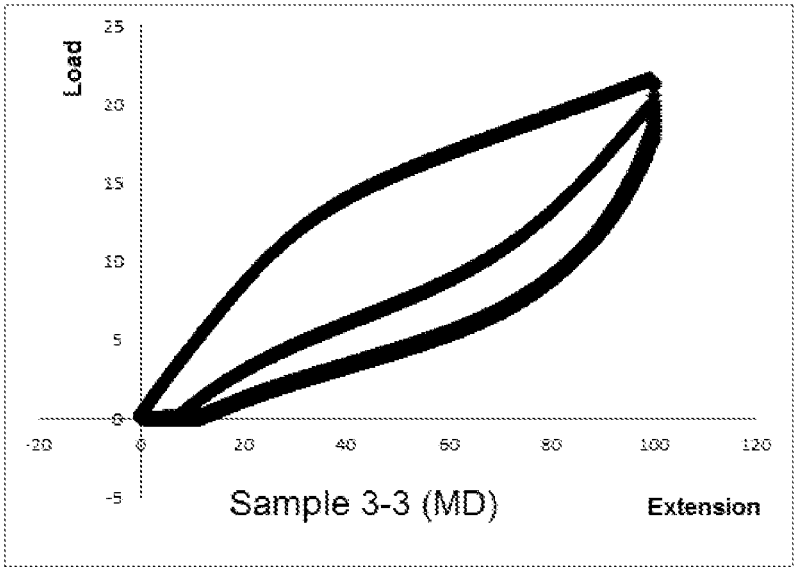
FIGS. 9*a* and 9*b* are plots of the force exerted on spunbond fabrics of Sample 3-3 of Example 3 vs. the extension of those samples through two cycles of extension and retraction for hysteresis testing, in the MD and the CD, respectively.
Figure 9B:
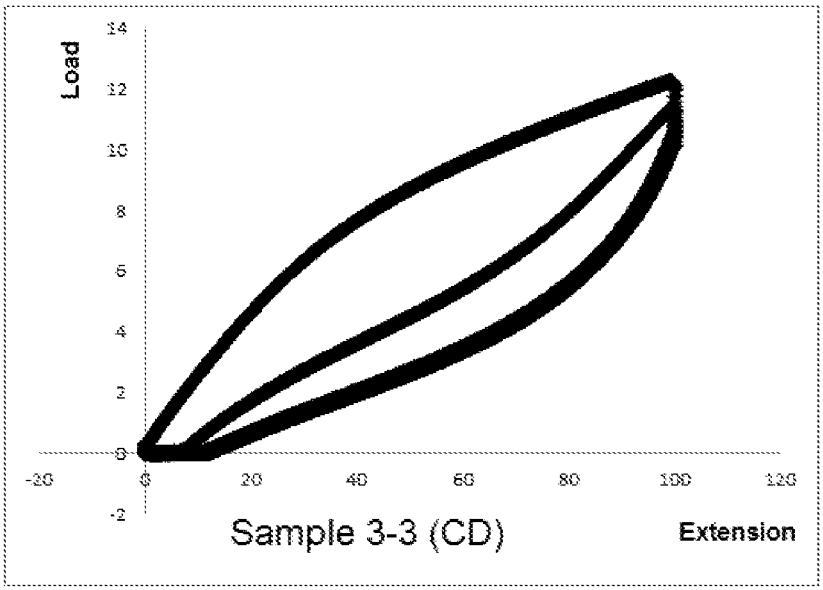
Figure 10A:
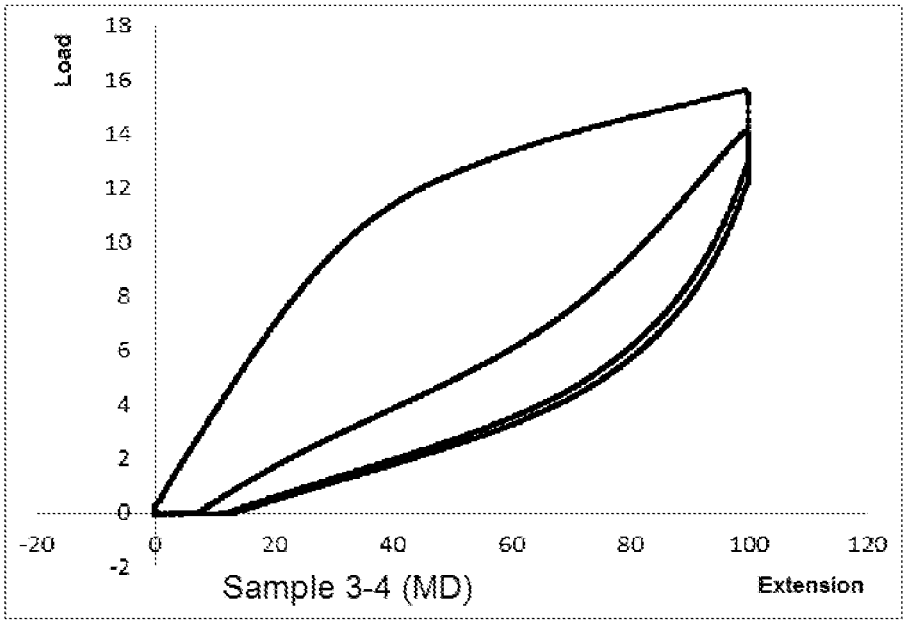
FIGS. 10*a* and 10*b* are plots of the force exerted on spunbond fabrics of Sample 3-4 of Example 3 vs. the extension of those samples through two cycles of extension and retraction for hysteresis testing, in the MD and the CD, respectively.
Figure 10B:
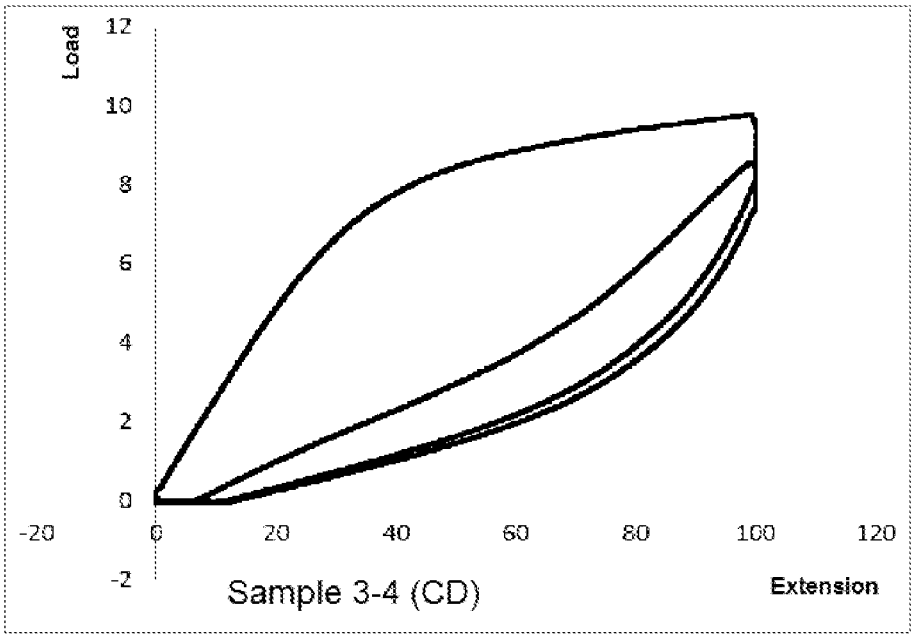

Tensile and hysteresis properties of the resulting spunbond fabric were determined in the same manner as with Examples 1 and 2. Tensile strength properties are reported in Table 11. Hysteresis properties are reported in Tables 12a and 12b. Hysteresis curves for Sample 3-1 in the MD and CD are shown in FIGS. 7*a* and 7*b*, respectively; curves for Sample 3-2 in the MD and CD are shown in FIGS. 8*a* and 8*b*, respectively; curves for Sample 3-3 in the MD and CD are shown in FIGS. 9*a* and 9*b*, respectively; and curves for Sample 3-4 in the MD and CD are shown in FIGS. 10*a* and 10*b*, respectively. The Example 3 samples demonstrate that even at low basis weight (Sample 3-1, having basis weight 30 gsm) and high basis weight (Samples 3-3 and 3-4, having 100 gsm), the inventive spunbond fabrics exhibit excellent elasticity and tensile strength.

TABLE 11a

Hysteresis of Example 3 Fabrics (1st Cycle)

| | MD 1st Cycle Elasticity | | | | CD 1st Cycle Elasticity | | | |
|---|---|---|---|---|---|---|---|---|
| Sample ID | Peak load (N) | Hysteresis (%) | Permanent Set (%) | 50% unloading force (N/5 cm) | Peak load (N) | Hysteresis (%) | Permanent Set (%) | 50% unloading force (N/5 cm) |
| 3-1 | 9.5 | 62.0 | 11.0 | 2.1 | 4.2 | 57.4 | 14.2 | 1.0 |
| 3-2 | 12.3 | 60.0 | 11.2 | 2.9 | 7.4 | 58.4 | 12.2 | 1.8 |
| 3-3 | 21.2 | 61.6 | 11.4 | 4.4 | 11.8 | 58.4 | 12.5 | 2.7 |
| 3-4 | 15.6 | 68.8 | 13.4 | 2.8 | 9.5 | 69.6 | 14.4 | 1.6 |

TABLE 11b

Hysteresis of Example 3 Fabrics (2nd Cycle)

| | MD $2^{nd}$ Cycle Elasticity | | | | CD $2^{nd}$ Cycle Elasticity | | | |
|---|---|---|---|---|---|---|---|---|
| Sample ID | Peak Load (N) | Hysteresis (%) | Permanent Set (%) | 50% unloading force (N/5 cm) | Peak Load (N) | Hysteresis (%) | Permanent Set (%) | 50% unloading force (N/5 cm) |
| 3-1 | 8.9 | 36.2 | 4.9 | 2.0 | 3.9 | 34.6 | 5.0 | 0.9 |
| 3-2 | 11.5 | 35.3 | 5.0 | 2.8 | 7.0 | 35.0 | 5.3 | 1.7 |
| 3-3 | 19.9 | 35.8 | 5.1 | 4.2 | 11.1 | 35.0 | 5.6 | 2.6 |
| 3-4 | 14.2 | 41.3 | 6.3 | 2.5 | 8.5 | 41.3 | 6.6 | 1.5 |

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention. Further, the term "comprising" is considered synonymous with the term "including." Likewise whenever a composition, an element or a group of elements is preceded with the transitional phrase "comprising," it is understood that we also contemplate the same composition or group of elements with transitional phrases "consisting essentially of," "consisting of," "selected from the group consisting of," or "is" preceding the recitation of the composition, element, or elements and vice versa, unless the context makes clear otherwise. Furthermore, all patents, articles, and other documents specifically referenced are hereby incorporated by reference.

What is claimed is:

1. A method comprising:

extruding a polymer composition so as to form a plurality of filaments, wherein the polymer composition comprises at least 90 wt % of an elastomer component consisting of a propylene-ethylene copolymer having an ethylene content of 10 wt % to 14.5 wt % and a propylene content of 85.5 wt % to 90 wt %, the weight percentages based upon the total weight of the propylene-ethylene copolymer, and further having a melt flow rate (MFR) (ASTM D-1238, 2.16 kg weight @ 230° C.) of 30 g/10 min to 80 g/10 min; and forming a spunbond material from the plurality of filaments.

2. The method of claim 1, wherein the polymer composition further comprises a slip aid.

3. The method of claim 1, wherein the polymer composition comprises 10 wt % or less of a propylene-based thermoplastic polymer, the wt % based upon total weight of the polymer composition.

4. The method of claim 3, wherein the propylene-based thermoplastic polymer is a homopolypropylene.

5. The method of claim 1, wherein the polymer composition consists essentially of (i) the elastomer component, (ii) 0 to 3 wt % of a propylene-based thermoplastic resin, and (iii) optionally, one or more additives.

6. The method of claim 5, wherein the one or more additives are each independently selected from nucleating agents, stabilizers, antioxidants, fillers, and slip aids.

7. The method of claim 5, wherein the polymer composition consists essentially of the elastomer component.

8. The method of claim 1, wherein the polymer composition consists of (i) the elastomer component, (ii) 0 to 3 wt % of a propylene-based thermoplastic resin, and (iii) optionally, one or more additives.

9. The method of claim 1, wherein the polymer composition is extruded through a spinneret at a melt temperature of 210° C. or less, thereby forming the plurality of filaments.

10. The method of claim 1, wherein the spunbond material is a spunbond fabric having a machine direction (MD) and a cross direction (CD).

11. A spunbond fabric made by the method of claim 1.

* * * * *